US011800920B2

(12) United States Patent
Yan et al.

(10) Patent No.: US 11,800,920 B2
(45) Date of Patent: Oct. 31, 2023

(54) REFILLABLE DISPENSER FOR A STICK PRODUCT

(71) Applicant: ELC Management LLC, Melville, NY (US)

(72) Inventors: Jian Yan, Kirkland (CA); Chad Garrison, Port Jefferson, NY (US)

(73) Assignee: ELC Management LLC, Melville, NY (US)

( * ) Notice: Subject to any disclaimer, the term of this patent is extended or adjusted under 35 U.S.C. 154(b) by 473 days.

(21) Appl. No.: 17/209,843

(22) Filed: Mar. 23, 2021

(65) Prior Publication Data

US 2022/0304452 A1 Sep. 29, 2022

(51) Int. Cl.

| | |
|---|---|
| ***A45D 40/06*** | (2006.01) |
| ***A45D 40/04*** | (2006.01) |
| ***A45D 40/00*** | (2006.01) |
| ***A45D 40/20*** | (2006.01) |

(52) U.S. Cl.

CPC ..... *A45D 40/06* (2013.01); *A45D 40/04* (2013.01); *A45D 2040/0031* (2013.01); *A45D 2040/0037* (2013.01); *A45D 2040/204* (2013.01)

(58) Field of Classification Search

CPC ..... A45D 40/06; A45D 40/04; A45D 40/00; A45D 40/205; A45D 2040/0037; A45D 2040/0031; A45D 2040/0043; A45D 2040/005; A45D 2040/208; A45D 2040/204; B65D 83/0011

USPC ..... 401/68, 75, 88, 172–174

See application file for complete search history.

(56) References Cited

U.S. PATENT DOCUMENTS

| | | | | |
|---|---|---|---|---|
| 6,158,911 | A | 12/2000 | Seebach, Jr. et al. | |
| 10,561,223 | B2 * | 2/2020 | Crawford | A45D 40/04 |
| 2010/0054842 | A1 | 3/2010 | DeVito et al. | |
| 2019/0246769 | A1 | 8/2019 | Genelot et al. | |
| 2020/0154852 | A1 | 5/2020 | Lee | |
| 2020/0283221 | A1 | 9/2020 | Zhang | |
| 2021/0007463 | A1 | 1/2021 | Lee | |
| 2022/0087399 | A1 * | 3/2022 | Dunton | A45D 40/16 |

FOREIGN PATENT DOCUMENTS

| | | | |
|---|---|---|---|
| GB | 1281886 | A | 7/1972 |
| JP | 10075820 | A | 3/1998 |
| JP | 2011218046 | A | 11/2011 |
| KR | 19990006048 | U | 12/1999 |
| KR | 20030010147 | A | 2/2003 |
| KR | 101843828 | B1 | 5/2018 |
| KR | 10-2038420 | B1 | 10/2019 |

OTHER PUBLICATIONS

Taiwan Search Report from TW Application No. 111110363; dated Dec. 12, 2022; 20.51.

(Continued)

*Primary Examiner* — David J Walczak

(74) *Attorney, Agent, or Firm* — Peter Giancana

(57) ABSTRACT

A refillable dispenser for a stick product comprises a holder cup, an A-shell and an inner base. Preferably, the dispenser will also comprise an outer base and a closure. The holder cup and A-shell form a cartridge subassembly for a stick product that can be bottom filled, and removed and replaced as needed. The dispenser requires no lubricant.

11 Claims, 21 Drawing Sheets

(56) References Cited

OTHER PUBLICATIONS

PCT International Search Report; International Application No. PCT/US2022/020179; Completion Date: Jul. 1, 2022; dated Jul. 4, 2022; 20.51.
PCT Written Opinion of the International Searching Authority; International Application No. PCT/US2022/020179; Completion Date: Jul. 1, 2022; dated Jul. 4, 2022; 20.51.

* cited by examiner

REFILLABLE DISPENSER FOR A STICK PRODUCT

FIELD OF THE INVENTION

The present invention relates to dispensers for stick products, such as lipstick. More particularly, it relates to a refillable dispenser that utilizes replaceable cartridges of stick products.

BACKGROUND

Prior art containers for stick products may include a cylinder that has a rotatable member disposed at its bottom end. The stick product is received into a holder cup, and the holder cup is disposed within the cylinder. Rotation of the rotatable member relative to the cylinder causes a mechanism inside the cylinder to advance the stick product longitudinally away from the rotating member such that a portion of the stick product becomes exposed above the cylinder. In this manner, the exposed portion of the product is available for application. One type of design makes use a screw-threaded follower that rides on a threaded shaft. US2020/0154852 A1 and GB1281886A are of this type. Neither of these discloses a refillable dispenser, and bottom-fillable replacement cartridge. Also, in use, surfaces that slide over each other, either in rotation or translation, experience a significant degree of friction. For this reason, it is common to apply a lubricant to those surfaces that move over each other. Eliminating the need for a lubricant would make manufacture and assembly easier and less costly.

OBJECTS OF THE INVENTION

A main object of the invention is to provide a dispenser for stick products that utilizes reusable parts and replaceable cartridges of stick products.

Another object of the invention is to provide a replaceable cartridges of stick products that are bottom-filled.

Another object of the invention is to provide a dispenser for stick products that uses no lubricant.

SUMMARY OF THE INVENTION

A refillable dispenser for a stick product according to the present invention comprises a holder cup, an A-shell and an inner base. The holder cup and A-shell form a cartridge subassembly for a stick product that can be removed and replaced as needed. Before the cartridge is assembled to the inner base, the holder cup and A-shell cannot move relative to each other. After the cartridge is assembled to the inner base, the holder cup can translate within the A-shell, but cannot rotate with respect to the A-shell. Preferably, the dispenser will also comprise an outer base and a closure.

DESCRIPTIONS OF THE FIGURES

DETAILED DESCRIPTION

Figure 1:
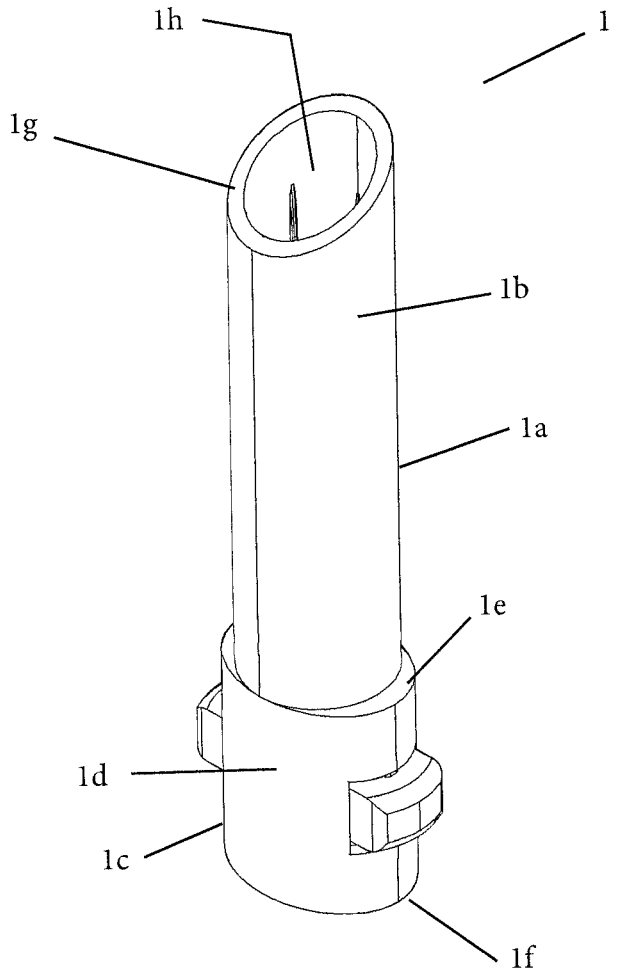
FIG. 1 depicts one embodiment of a holder cup for a stick product.
Figure 2:
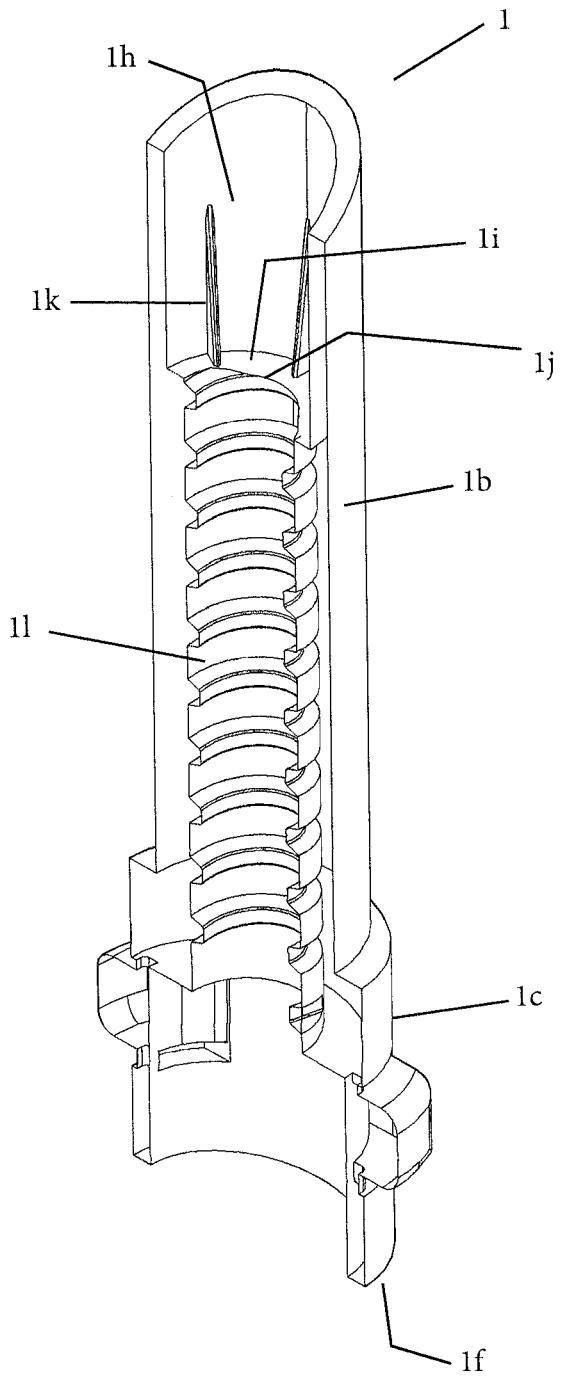
FIG. 2 is a cross sectional view of the holder cup of FIG. 1.
Figure 3:
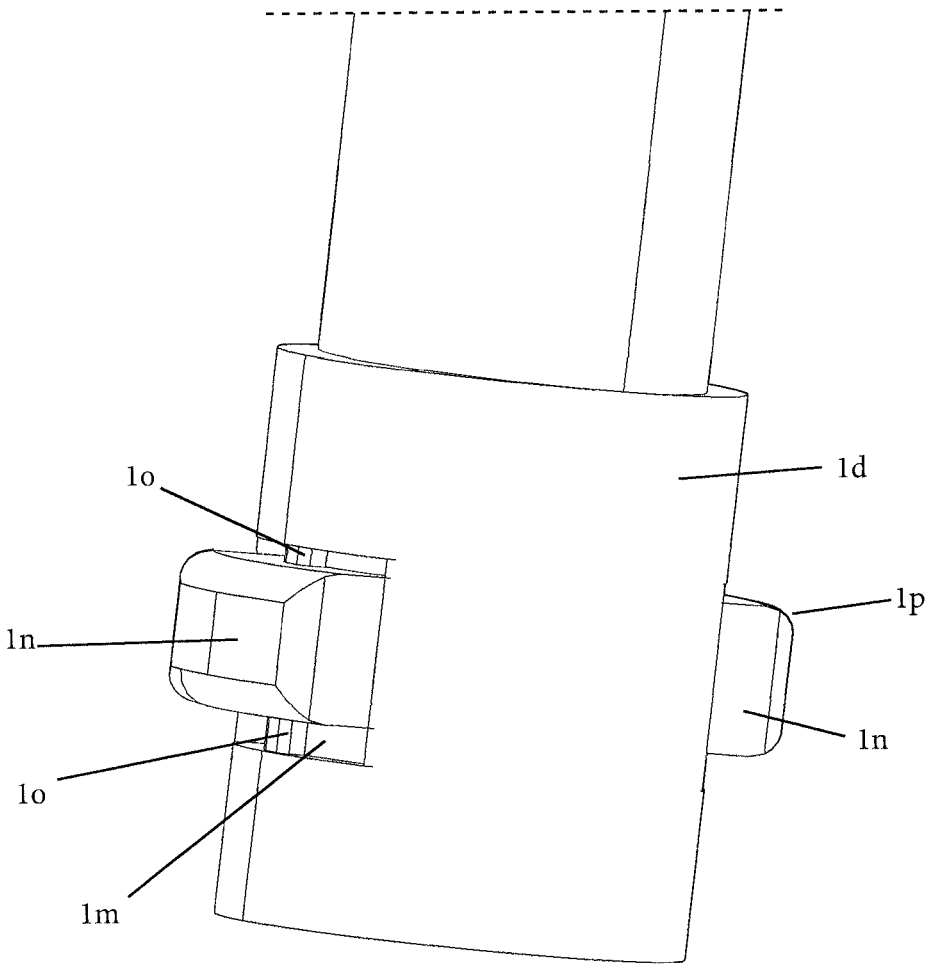
FIG. 3 is a close up of the lower step of holder cup of FIG. 1.
Figure 4:
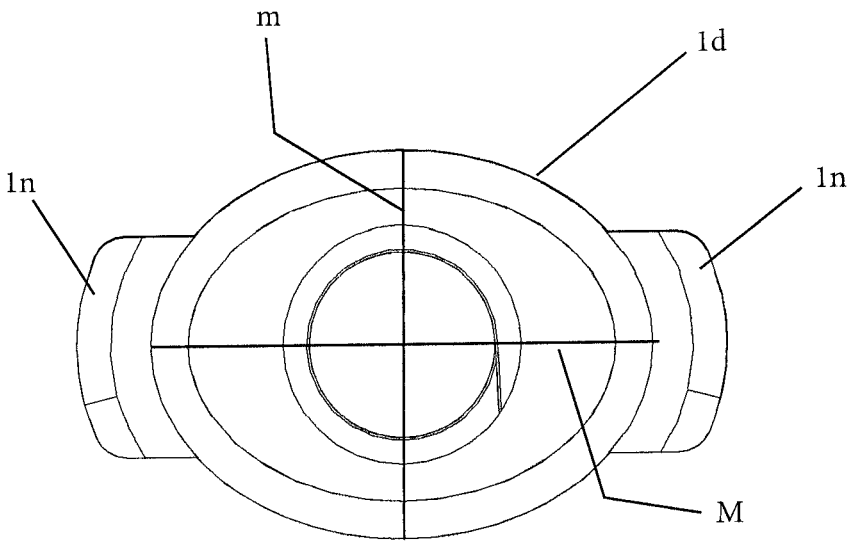
FIG. 4 is a top view of the holder cup for FIG. 1.
Figure 5:
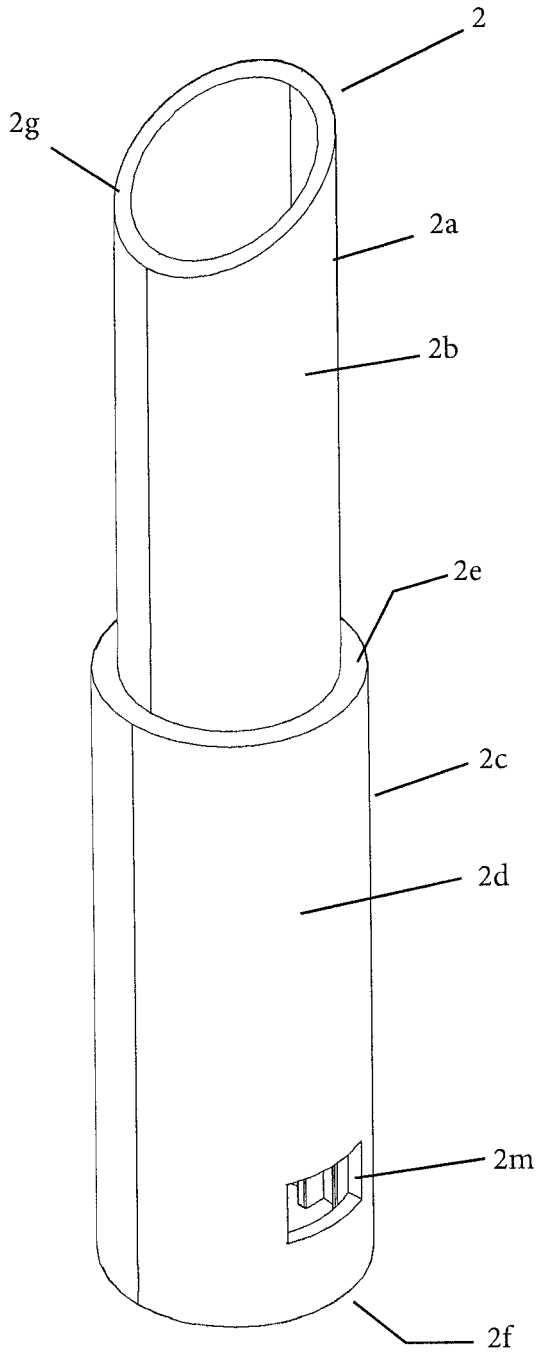
FIG. 5 depicts one embodiment of an A-shell.

The term "comprises" means that a list of elements may not be limited to those explicitly recited.

A refillable dispenser (10) for a stick product (9) according to the present invention comprises a replaceable cartridge subassembly (8). The cartridge subassembly comprises an A-shell (2) and a holder cup (1) that is completely inserted into the A-shell, such that the holder cup and A-shell cannot freely rotate or translate relative to each other. The refillable dispenser also comprises a inner base (3) that cooperates with the cartridge subassembly to enable the holder cup to translate up and down within the A-shell, but not freely rotate. Preferably, the dispenser will also comprise an outer base (4) and a closure (5).

Replaceable Cartridge Subassembly

Holder Cup

Referring to FIGS. 1-4, the holder cup (1) is fashioned as a hollow stepped tube. The upper step (1*a*) comprises a wall (1*b*). The lower step (1*c*) comprises a wall (1*d*). The lower step is larger than the upper step in its lateral dimensions, such that a shoulder (le) exists at the transition from the lower step to the upper step of the holder cup. The holder cup has a proximal end (1*f*) that corresponds to the free end of the lower step, and a distal end (1*g*) that corresponds to the free end of the upper step.

The interior of the distal end (1*g*) of the holder cup (1) is fashioned as a cup (1*h*). The cup is defined by a portion of the cylindrical wall (1*b*) of the upper step, and by a bottom (1*i*) that extends radially inward from the inner surface of the cylindrical wall. Preferably, the bottom of the cup has an opening (1*j*) for product filling (see below). The cup is able to support one end of a stick product (9), and retain the stick product during normal, intended use. To ensure retention, several vertical splines (1*k*) may be provided on the inner surface and bottom of the cup, as is commonly done in the art. Below the level of the cup (1*h*), the inner surface of the cylindrical wall (1*b*) of the upper step (1*a*) of the holder cup (1) is formed as a threaded shaft (1*l*) that extends down into the lower step (1*c*), but may not extend all the way to the proximal end (1*f*) of the holder cup.

The wall (1*d*) of the lower step (1*c*) is provided with at least one cutout (1*m*). Preferably, there are two cutouts located opposite to each other. Positioned in the at least one cutout is a tab (1*n*) the juts radially outward. Each tab is connected to the wall of the lower step by flexible struts (1*o*) that allow the tab to move radially inward when pressure is applied to the tab, and then return again when pressure is removed. As will be shown, it is preferable if the edges (1*p*) of the tab are rounded. Preferably, the radius of curvature of the rounded edges is equal to or greater than the thickness of the wall (2*b*) of the upper step (2*a*) of the A-shell (2) (see below).

A-Shell

Referring to FIGS. 5-8, the A-shell (2) is also formed as a hollow stepped tube. The upper step (2*a*) of the A-shell comprises a wall (2*b*). The lower step (2*c*) of the A-shell comprises a wall (2*d*). The lower step is larger than the upper step in its lateral dimensions, such that a shoulder (2*e*) exists at the transition from the lower step to the upper step of the A-shell. The A-shell has a proximal end (2*f*) that corresponds to the free end of the lower step, and a distal end (2*g*) that corresponds to the free end of the upper step. The wall of the lower step is provided with at least one aperture (2*m*). Preferably, there are two apertures that are located opposite to each other.

Figure 6:
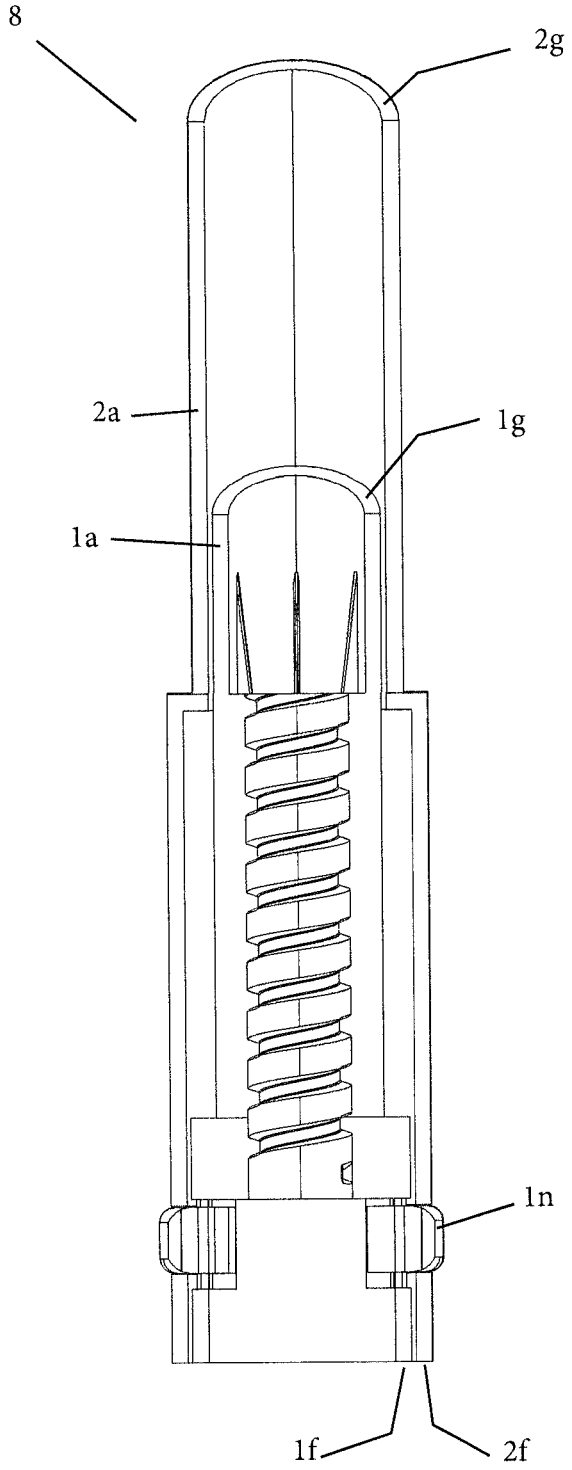
FIG. 6 is a cross sectional view of the cartridge subassembly (the holder cup of FIG. 1 inside the A-shell of FIG. 5).
Figure 7:
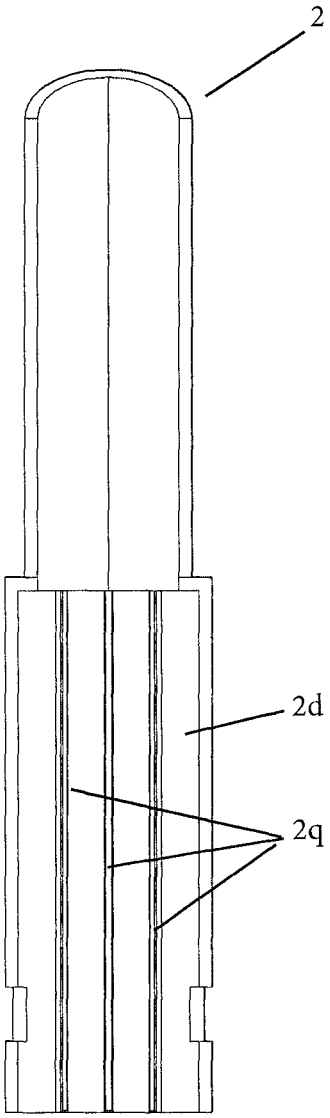
FIG. 7 is a cross sectional view of the A-shell of FIG. 5
Figure 8:
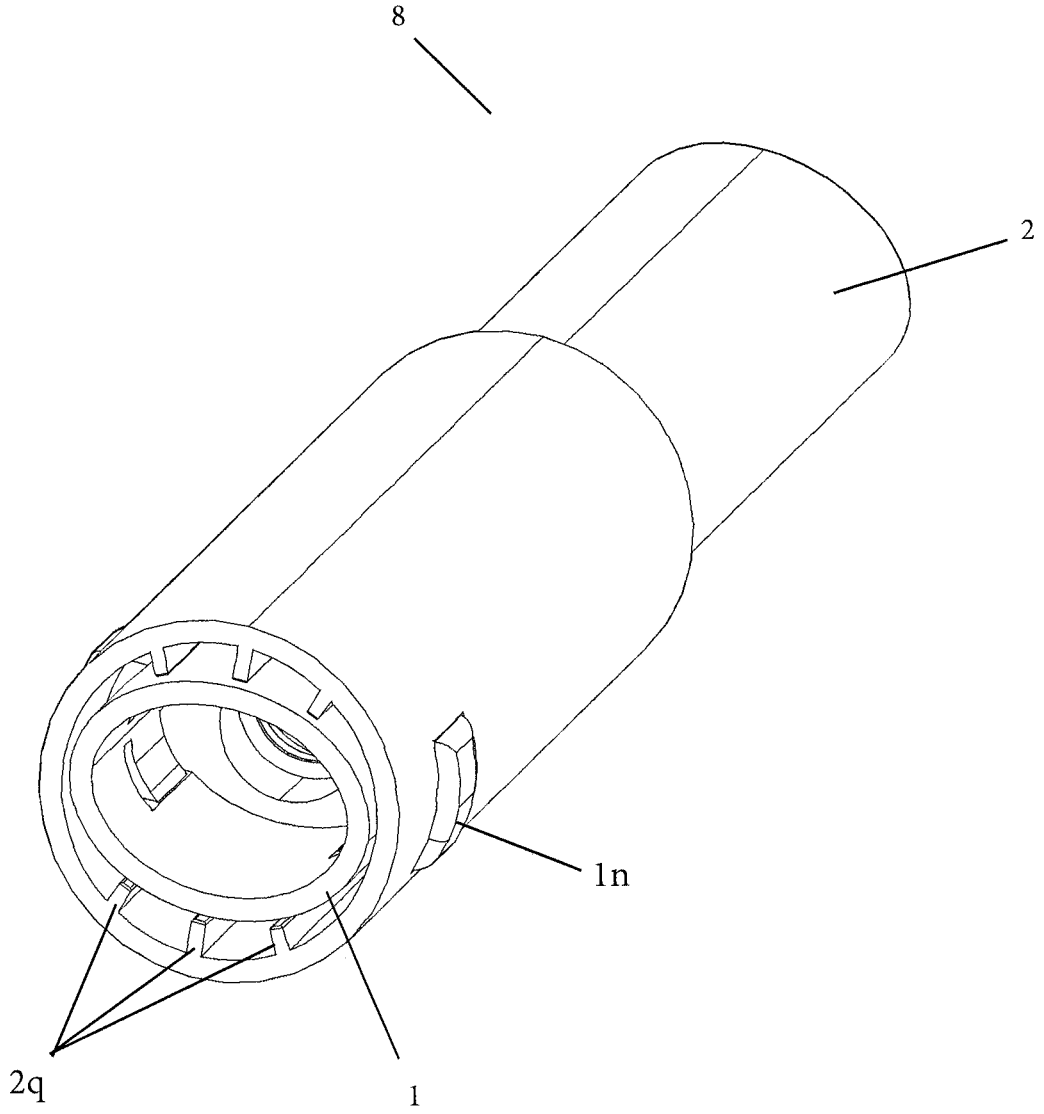
FIG. 8 is a bottom perspective view of the cartridge subassembly of FIG. 6.
Figure 9:
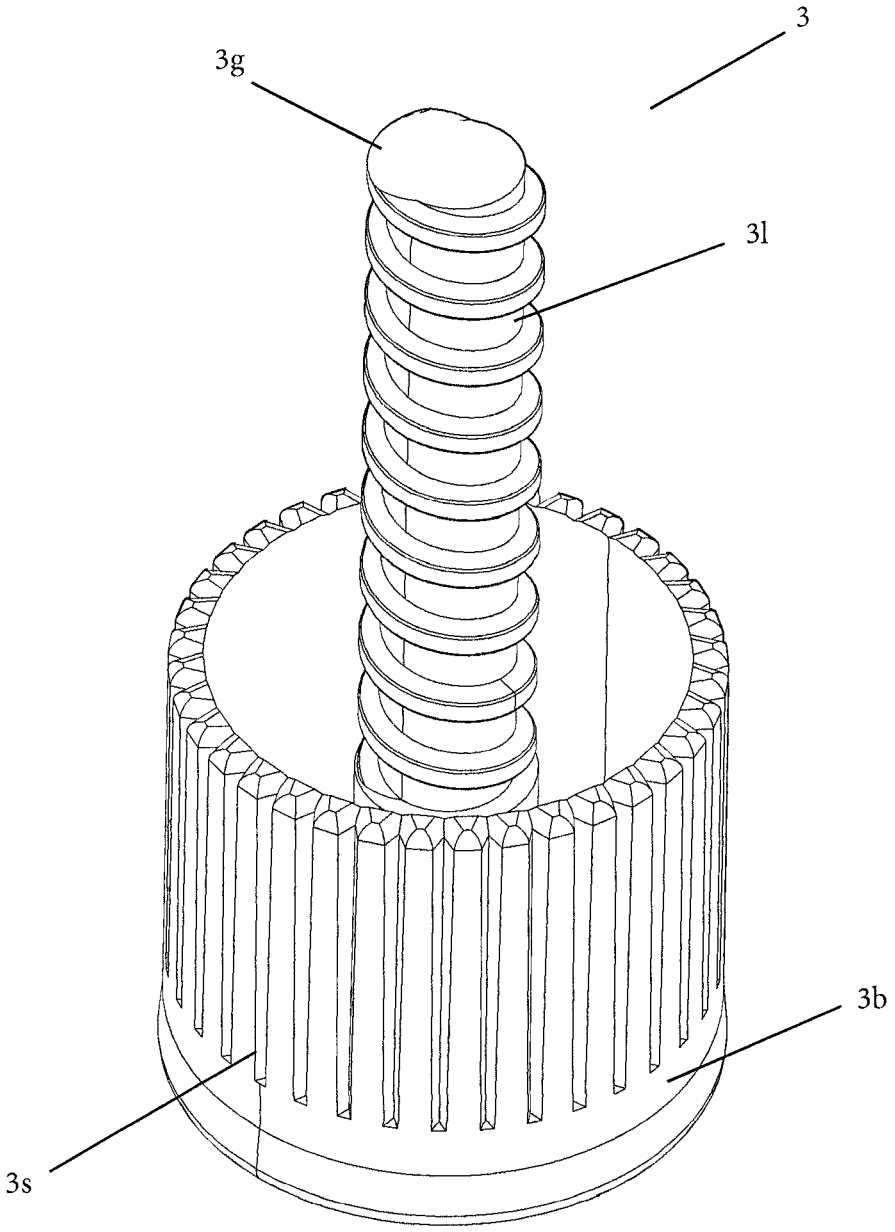
FIG. 9 depicts one embodiment of an inner base.
Figure 10:
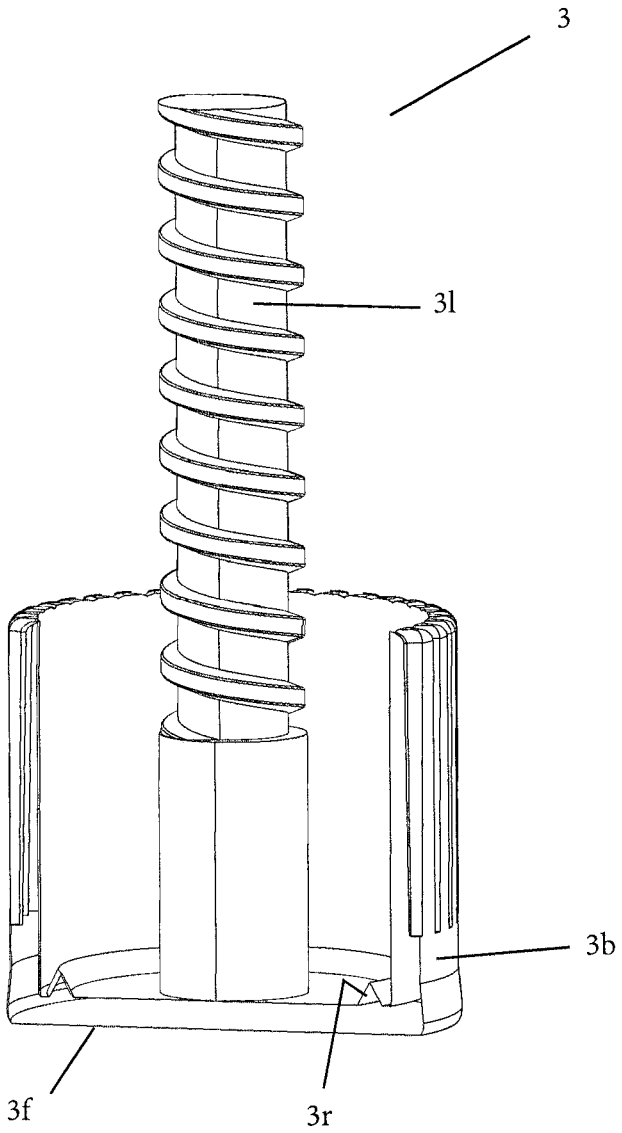
FIG. 10 is a cross sectional view of the inner base FIG. 9.
Figure 11:
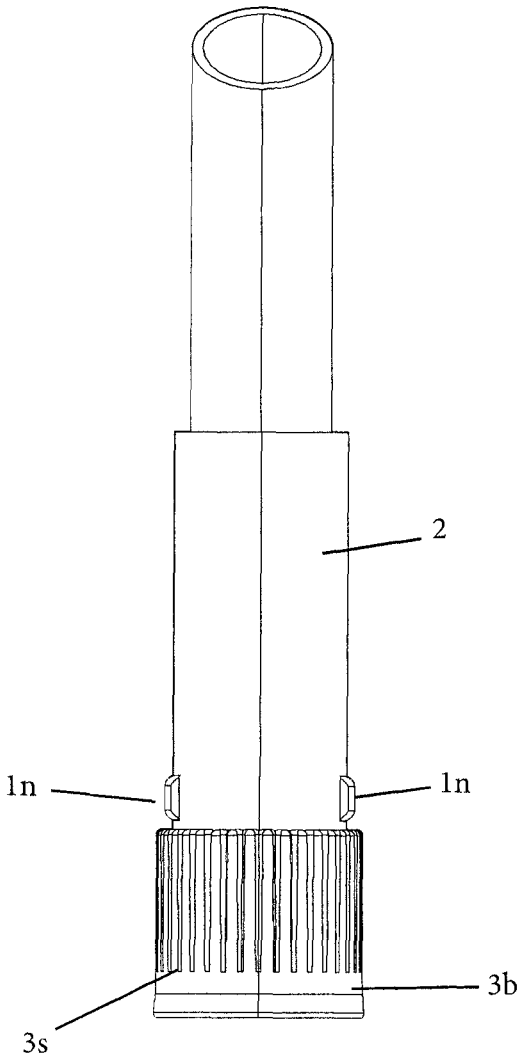
FIG. 11 is an elevation view of one embodiment of a refillable dispenser, with the inner base not quite fully assembled.
Figure 12:
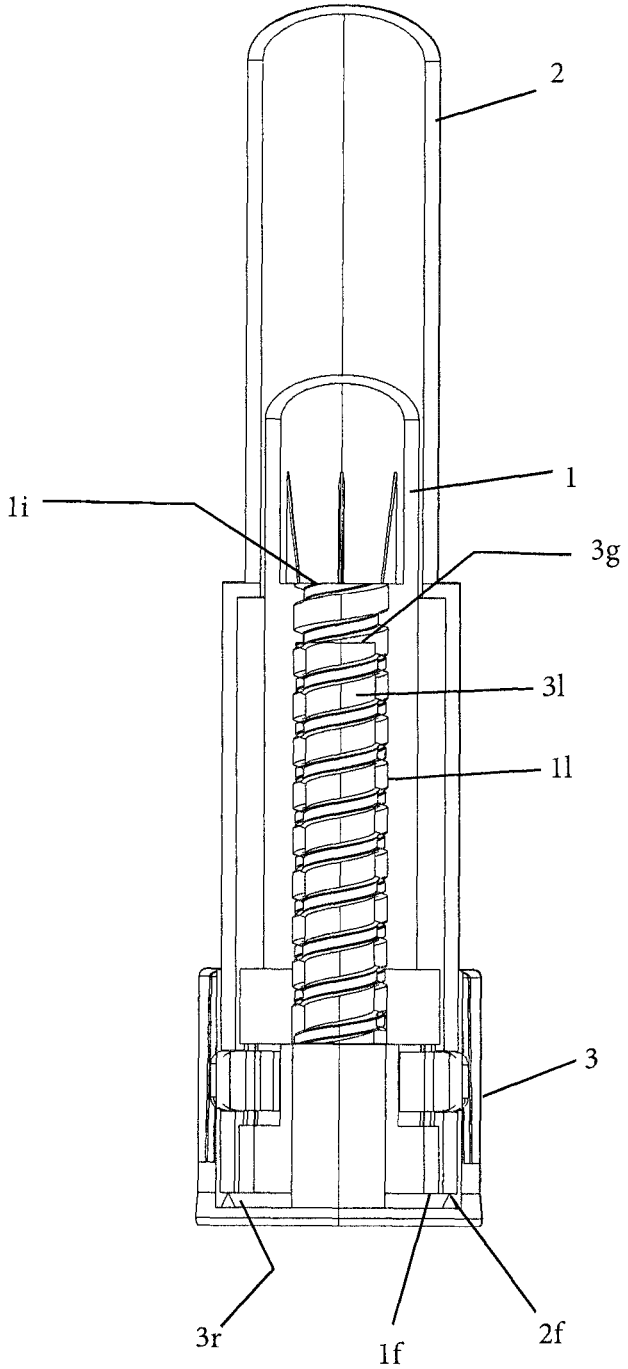
FIG. 12 is a cross sectional view of the dispenser of FIG. 11, with the inner base fully assembled.

The A-shell (2) is sized to allow the holder cup (1) to be completely inserted into the A-shell (see FIG. 6). For example, the overall length of the A-shell, from proximal end (2*f*) to distal end (2*g*), is greater than the overall length of the holder cup. Also, upper step (2*a*) of the A-shell is large enough to accommodate the upper step (1*a*) of the holder cup, and the lower step (2*c*) of the A-shell is large enough to accommodate the lower step (1*c*) of the holder cup. Therefore, when the distal end (1*g*) of the holder cup is inserted through the proximal end (2*f*) of the A-shell, then the upper step (1*a*) of the holder cup fits into the upper step (2*a*) of the A-shell, and the lower step (1*c*) of the holder cup fits into the lower step (2*c*) the A-shell. However, in their resting position, the tabs (1*n*) of the holder cup (1) would prevent the holder cup from being completely inserted into the A-shell (2). Therefore, to completely assemble the holder cup into the A-shell, the tabs must be displaced radially inward. As mentioned, it is preferable that the edges (1*p*) of the tabs are rounded with a radius of curvature equal to or greater than the thickness of the lower cylindrical wall (2*d*) of the lower step (2*c*) of the A-shell. This will make it easier for the tabs (1*n*) to enter into the proximal end (2*f*) of the A-shell. When the holder cup is fully assembled into the A-shell, then the tabs of the holder cup align with the apertures (2*m*) of the A-shell. This allows the tabs to return to their resting position and protrude through apertures of the A-shell. The subassembly of the A-shell and holder cup form the replaceable cartridge (8). The proximal and distal ends of the cartridge coincide with the proximal (2*f*) and distal (2*g*) ends of the A-shell. Furthermore, in the arrangement shown in FIGS. 6 and 8, the holder cup (1) and A-shell (2) are locked, so that they cannot move relative to each other (except perhaps, some inconsequential amount); neither in rotation, nor in translation. In use, however, to extend the stick product (9), it will be necessary to allow the holder cup to translate relative to the A-shell, but still not rotate. As we will see, translation will be enabled by depressing the tabs (1*n*) of the holder cup, and, as a result, means must be provided to prevent rotation between the holder cup and A-shell. The phrase "prevent rotation" means that only inconsequential rotation may occur, due to a small amount of play in the components.

Anti-Rotation Means—First Example

One example of preventing rotation between the holder cup (1) and A-shell (2) requires the lower step (1*c*) of the holder cup and the lower step (2*c*) of the A-shell to have different cross sectional shapes, such that the lower step of the holder cup can fit into the lower step of the A-shell in at least one relative orientation, and cannot fit into the lower step of the A-shell in at least one other relative orientation. For example, the lower step of the holder cup may have a non-circular cross section, such as an oval, with a major axis (M) and a minor axis (m) (as shown in FIGS. 1-4), and the two tabs (1*n*) located at either apex of the oval wall along the major axis (M). At the same time, the lower step (2*c*) of the A-shell is such that the lower step of the holder cup can fit into it, but only when the tabs of the holder cup line up with the apertures of the A-shell. For example, if the lower step of the A-shell is cylindrical, then the inner surface of the lower step of the A-shell may have at least one, preferably at least two longitudinal splines (2*q*) that effectively reduce the inner dimensions of the lower step of the A-shell, so that it is smaller than the major axis (M) of the lower step of the holder cup. This may best be seen in FIG. 8. In this arrangement, the oval shaped lower step of the holder cup cannot rotate within the lower step of the A-shell. Furthermore, the longitudinal splines stabilize the holder cup during translation relative to the A-shell.

Anti-Rotation Means—Second Example

FIGS. 16-21 depict a second embodiment of a holder cup (1') and A-shell (2'). This embodiment demonstrates another means of preventing rotation between the holder cup and A-shell. The upper step (1*a*') of the holder cup (1') comprises a wall (1*b*') that has a non-circular cross section. Likewise, the upper step (2*a*') of the A-shell (2') comprises a wall (2*b*') that has the same cross section, only slightly larger, so that the upper step of the holder cup can fit into it. In this embodiment, even if the lower steps (1*c*', 2*c*') of the holder cup and A-shell comprise concentric cylindrical walls (1*d*', 2*d*'), the non circular cross sectional shape of the upper steps of the holder cup and A-shell will prevent relative rotation between those components. In general, there is a lot of freedom in choosing the cross sectional shapes of the holder cup (1') and A-shell (2'), which determines the shape of the stick product (9), and allows for unlimited design choices in the shape of the stick product (9).

Anti-Rotation Means—Third Example

Figure 16:
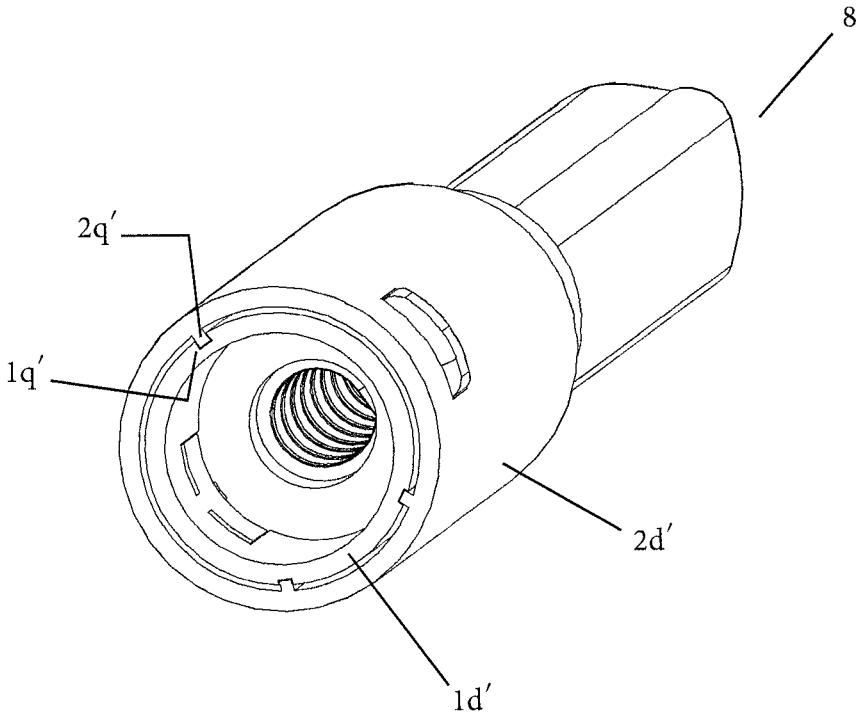
FIG. 16 is a bottom perspective view of a second embodiment of a cartridge subassembly.
Figure 17:
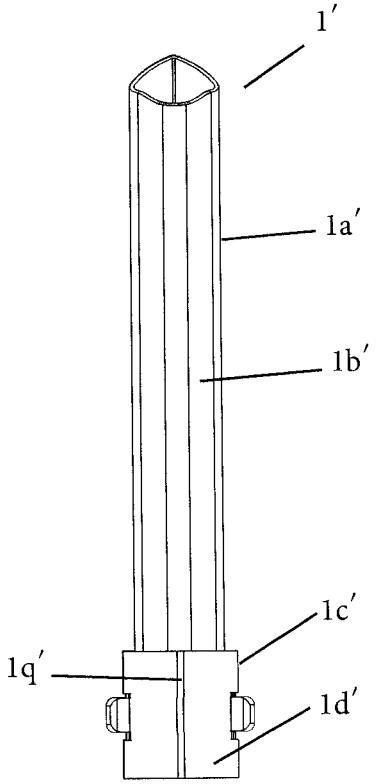
FIG. 17 depicts another embodiment of a holder cup for a stick product.
Figure 18:
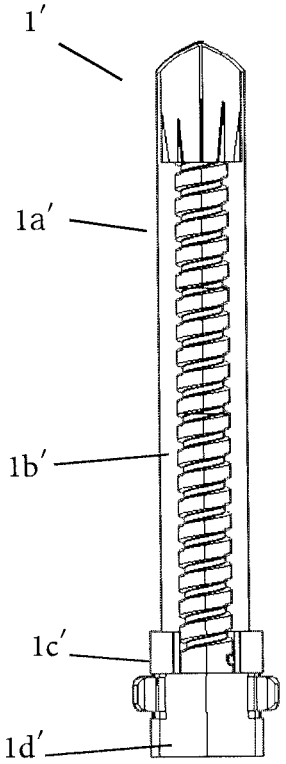
FIG. 18 is a cross sectional view of the holder cup of FIG. 17.
Figure 19:
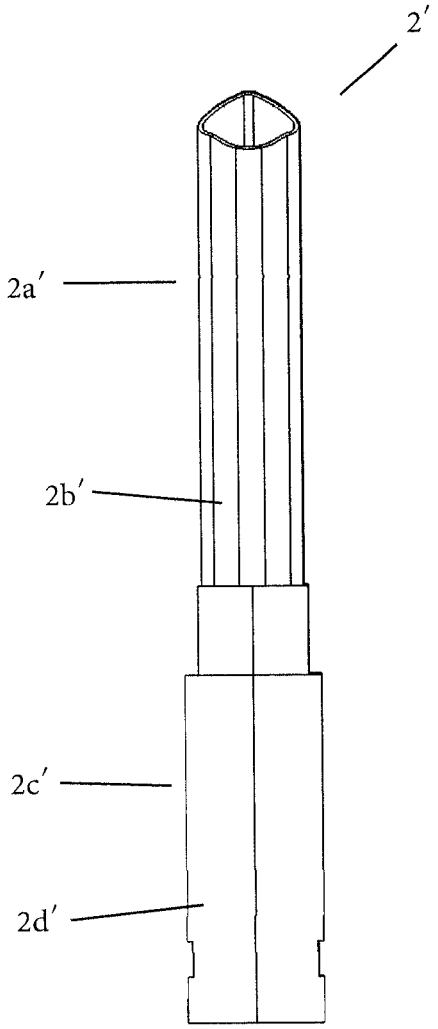
FIG. 19 depicts another embodiment of an A-shell.
Figure 20:
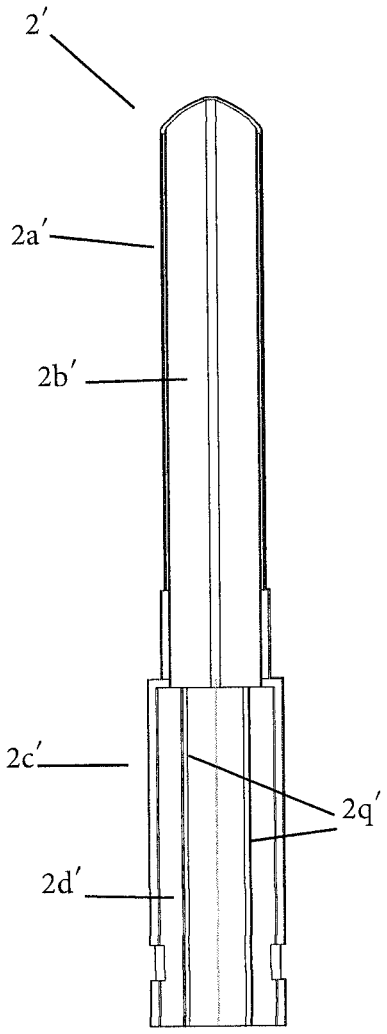
FIG. 20 is a cross sectional view of the A-shell of FIG. 19.
Figure 21:
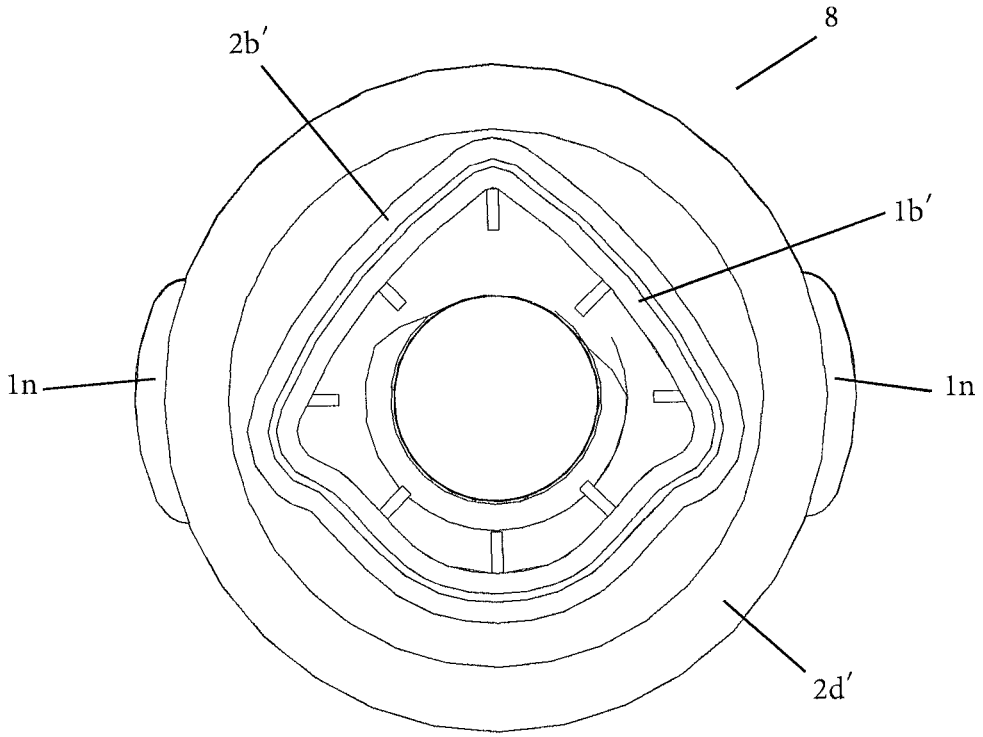
FIG. 21 is a top plan view of a cartridge subassembly (the holder cup of FIG. 17 inside the A-shell of FIG. 19).

In some embodiments other means of ensuring that the holder cup (1') and A-shell (2') cannot rotate relative to each other may be provided. For example, as shown in FIGS. 16, 17 and 20, the outer surface of the cylindrical wall (1*d*') of the lower step (1*c*') of the holder cup may be provided with one or more longitudinal grooves (1*q*') that are designed to receive an equal number of longitudinal flanges (2*q*') located on the inner surface of the cylindrical wall (2*d*') of the lower step (2*c*') of the A-shell. The holder cup will be table to translate up and down in the grooves, but not rotate relative to the A-shell.

Inner Base

Referring to FIGS. 9-12, the inner base (3) is fashioned as a cylindrical wall (3*b*) that is closed at its proximal end (3*f*). Arising from the inner surface of the closed end is a threaded spiral (3*l*). The threaded spiral rises above the cylindrical wall of the inner base, and is designed to cooperate with the threaded shaft (1*l*) of the holder cup (1). To assemble the cartridge (8) to the inner base, the threaded spiral (3*l*) of the inner base is inserted into the proximal end (1*f*) of the holder cup, and then threaded into the threaded shaft (1*l*) of the holder cup. This may be achieved by twisting the inner base while holding the A-shell (2) steady, or vice versa. The threaded spiral is shorter than the threaded shaft. Preferably, when fully assembled, the distal end (3*g*) of the threaded spiral (3*l*) is at least one full thread turn below the bottom (1*i*) of the holder cup (1) (see FIG. 12). More preferably, when fully assembled, the distal end of the threaded spiral is at least two full thread turns below the bottom of the holder cup. As will be described below, the extra space within the threaded shaft (1*l*) may be filled with product.

The inner diameter of the inner base (3) is sized to receive the proximal end (2*f*) of the A-shell (2). As the cartridge (8) is screwed onto the inner base (3), the tabs (1*n*) of the holder cup (1), which protrude through the apertures (2*m*) of the A-shell (2), will strike the cylindrical wall (3*b*) of the inner base. However, the rounded edges (1*p*) of the tabs will cause the tabs to deflect inwardly, allowing the cylindrical wall of the inner base to pass over the tabs. The inner base is screwed into the cartridge until the A-shell bottoms out on the closed end of the inner base. When fully assembled, the tabs (1*n*) of the holder cup (1) are inside the inner base (3), and biased inwardly by the cylindrical wall (3*b*) of the inner base. With this configuration (shown in FIG. 12), the holder cup can translate up and down within the A-shell (2), but not rotate. Translation of the holder cup (1) is achieved by a relative rotation of the A-shell (2) and the inner base (3).

During the raising and lowering of the holder cup, the A-shell is bottomed out on the closed proximal end (3*f*) of the inner base. In order to reduce friction between the A-shell and inner base, it may be preferable to provide an annular ridge (3*r*) on the closed end of the inner base. The A-shell would slide on the annular ridge. Due to the limited contact, the friction between the A-shell and inner base would be significantly reduced. This negates the need for any lubricant between the A-shell and inner base. Optionally, an outer base (4, see below) may be included. If that is the case, then the outside surface of the cylindrical wall (3*b*) of the inner base is provided with a plurality of longitudinal grooves (3*s*) that cooperate with an outer base.

Outer Base

Figure 13:
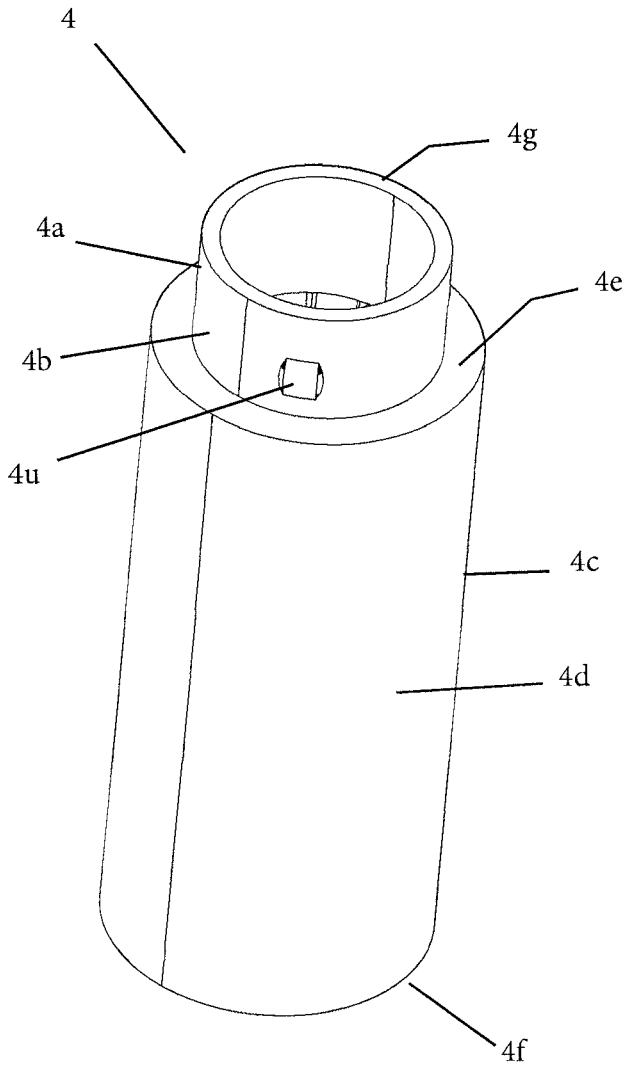
FIG. 13 depicts one embodiment of an outer base.
Figure 14:
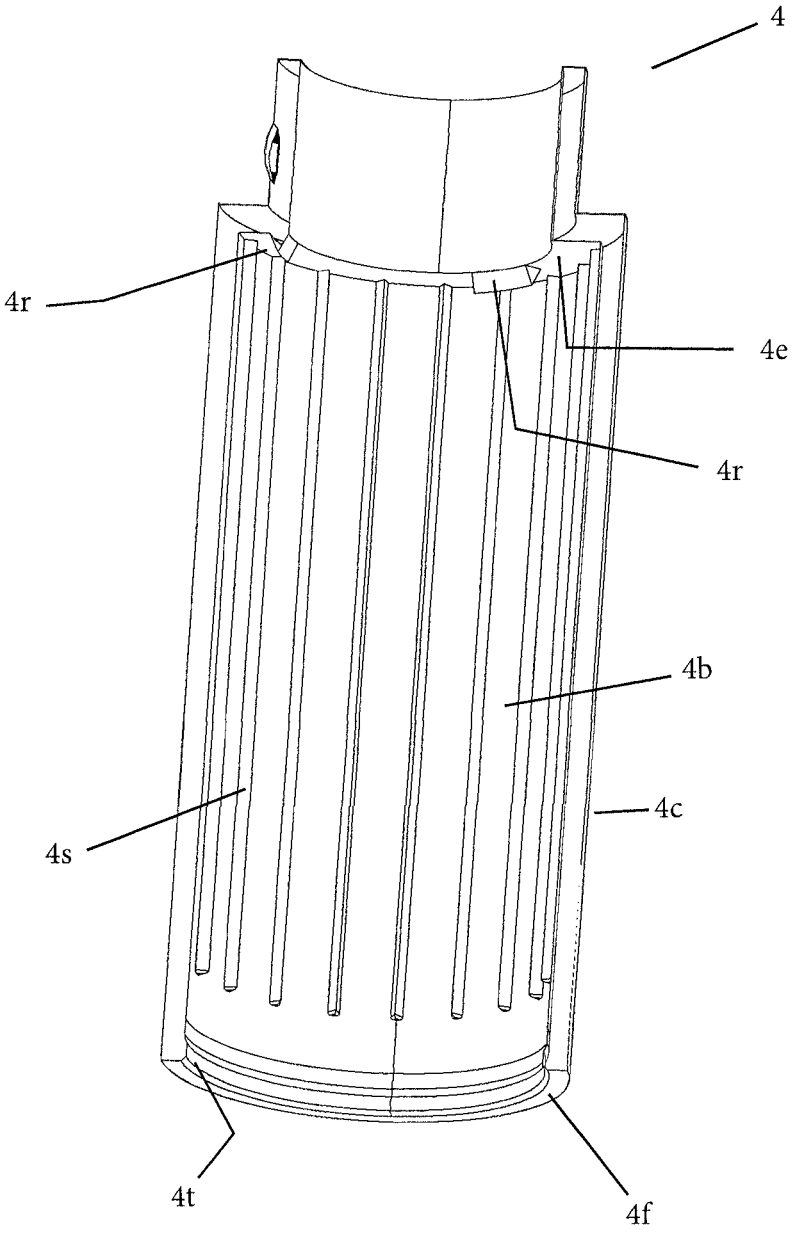
FIG. 14 is a cross sectional view of the outer base of FIG. 13.
Figure 15:
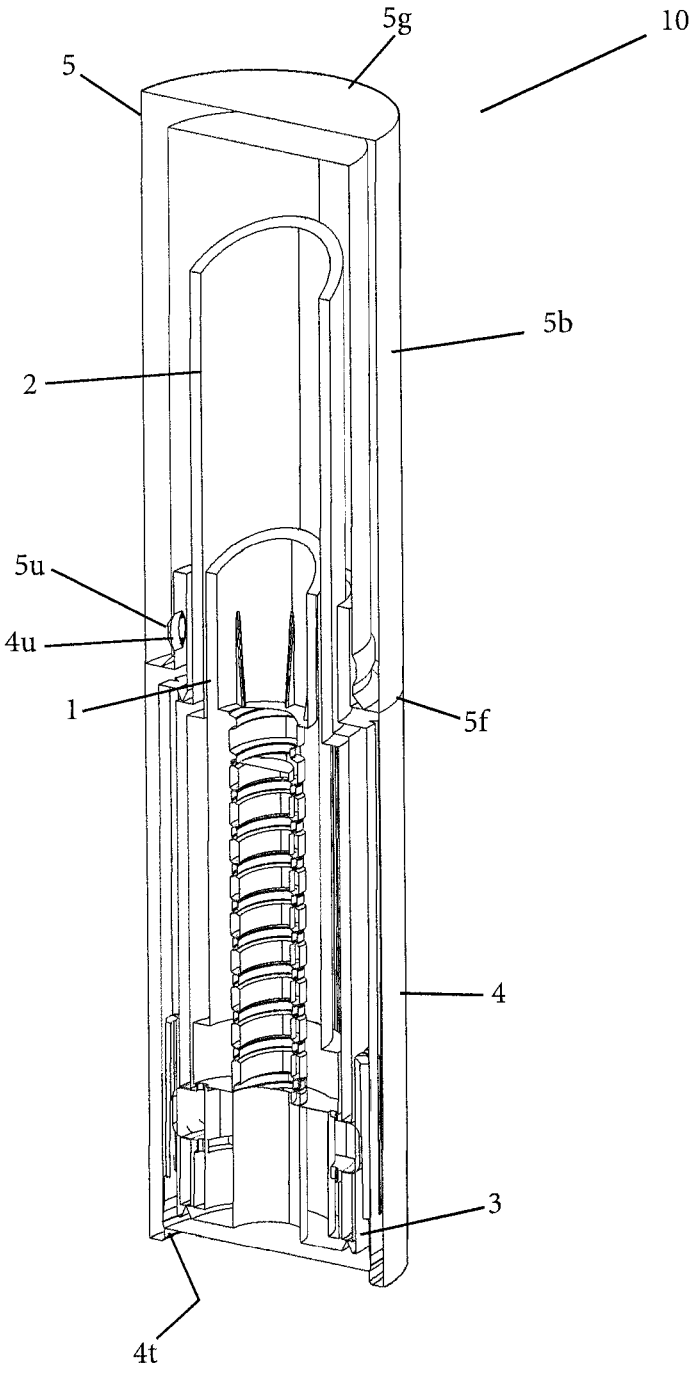
FIG. 15 is a cross sectional view of one embodiment of a refillable dispenser with outer base and closure assembled.

Optionally, an outer base (4) may be included. The outer base streamlines the appearance of the dispenser (10), and provides a surface for attaching a closure (5). Referring to FIGS. 13-15, in general, the outer base will be fashioned as another hollow stepped tube that comprises an upper step (4*a*) and a lower step (4*c*) with a shoulder (4*e*) in between. The upper step of the outer base comprises an upper cylindrical wall (4*b*) that has an outer diameter. The lower step of the outer base comprises a lower cylindrical wall (4*d*) that has an outer diameter. The lower step of the outer base is taller than the lower step (2*c*) of the A-shell (2). The outer base is opened at its proximal end (4*f*) and distal end (4*g*). The proximal end is designed to be slipped over the distal end (2*g*) of the A-shell, and slide down until the outer base covers the lower step (2*c*) of the A-shell and the inner base (3). The length of the upper step (4*a*) of the outer base is less than the upper step 2(*a*) of the A-shell, such that the distal end of the A-shell protrudes beyond the distal end of the outer base. This is necessary for the operation of the dispenser, because the A-shell and outer base must be gripped by the user.

When fully assembled, inner surface of the shoulder (4*e*) of the outer base (4) may contact the shoulder (2*e*) of the A-shell (2). Relative rotation between these surfaces during raising and lowering of the holder cup (1) will cause unwanted friction. In order to reduce this friction between the A-shell and outer base, it may be preferable to provide one or more arcuate ridges (4*r*) on the inner surface of the shoulder of the outer base. This would significantly reduce contact and, therefore, friction between the A-shell and outer base. This negates the need for any lubricant between the A-shell and outer base.

The inner surface of the cylindrical wall (4*d*) of the lower step (4*c*) of the outer base (4) comprises a plurality of longitudinal projections (4*s*). These projections are designed to cooperate with the plurality of longitudinal grooves (3*s*) that are located on the outside surface of the cylindrical wall (3*b*) of the inner base (3). For example, when the outer base is slipped onto the inner base, then the longitudinal projections of the outer base come to rest in the longitudinal grooves of the inner base. Once the inner and outer bases are joined in this manner, rotation of the inner base is achieved by rotating the outer base relative the A-shell. Also, the fit between the inner and out bases should be sufficiently tight to create a frictional force that will hold those components together during normal operation of the dispenser. This fit may be achieved by providing sufficient interference between the outer base and inner base, near the proximal end (4*f*) of the outer base. However, the fit should not be so tight that a user cannot separate the outer base from the inner base, which is necessary to replace the cartridge (8). Optionally, a circular retaining ring (4*t*) may be provided at the proximal end of the outer base to prevent the inner base and cartridge from accidentally backing out of the outer base.

Closure

Referring to FIG. 15, the distal end of the dispenser (10) should be fitted with a closure (5) when the stick product (9) is not in use. The closure comprises a lateral wall (5*b*) that is opened at its proximal end (5*f*), and closed at its distal end (5*g*). The closure fits over the upper step (2*a*) of the A-shell (2), and over the upper step (4*a*) of the outer base (4), if provided. The lateral wall (5*b*) of the closure is enabled to cooperate with cylindrical wall (2*b*) of the upper step (2*a*) of the A-shell and/or with the cylindrical wall (4*b*) of the upper step (4*a*) of the outer base. The closure may be held in place by any suitable means including friction, snap fitments, latches and threaded engagement. For example, the closure may simply make an interference fit on the upper step (2*a*) of the A-shell (2). Alternatively, an inner surface of the lateral wall (5*b*) of the closure may be provided with an annular groove (5*u*) into which retaining nibs (4*u*) of the outer base come to rest when the closure is fully seated on the outer base. Or, the closure and outer base may be provided with cooperating threads. Ideally, the closure and outer base will be able to form an airtight seal.

In a preferred embodiment, the refillable dispenser (10) comprises both an outer base (4) and a closure (5) that attaches to the outer base. When the closure is seated on the outer base, then the A-shell (2) is not accessible, and unintended raising of the holder cup (1) is not possible.

Stick Product

Figure 22:
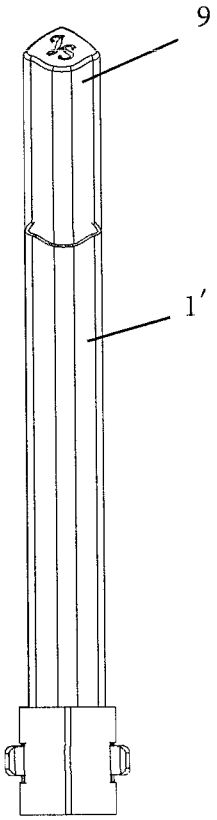
FIG. 22 depicts a holder cup and stick product with a non-circular cross section.

The cup (1*h*) of the holder cup (1) is able to support one end of a stick product (9; see FIG. 22), and retain the stick product during normal, intended use. Refillable dispensers (10) according to the present invention may be useful for all types of stick products (9) that are applied by drawing the product across a surface. These include lipsticks, lip balms, deodorant sticks, anti-perspirant sticks, glue sticks, etc. For purposes of the present invention, a stick product is an elongated mass of solid or semi-solid product that is able to support its own weight without breaking, when the elongated mass is suspended by one end.

Methods of Filling the Cartridge

Figure 23:
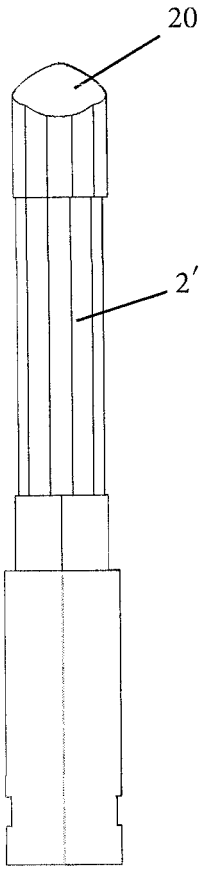
FIG. 23 depicts an A-shell and molding cap.
Figure 24:
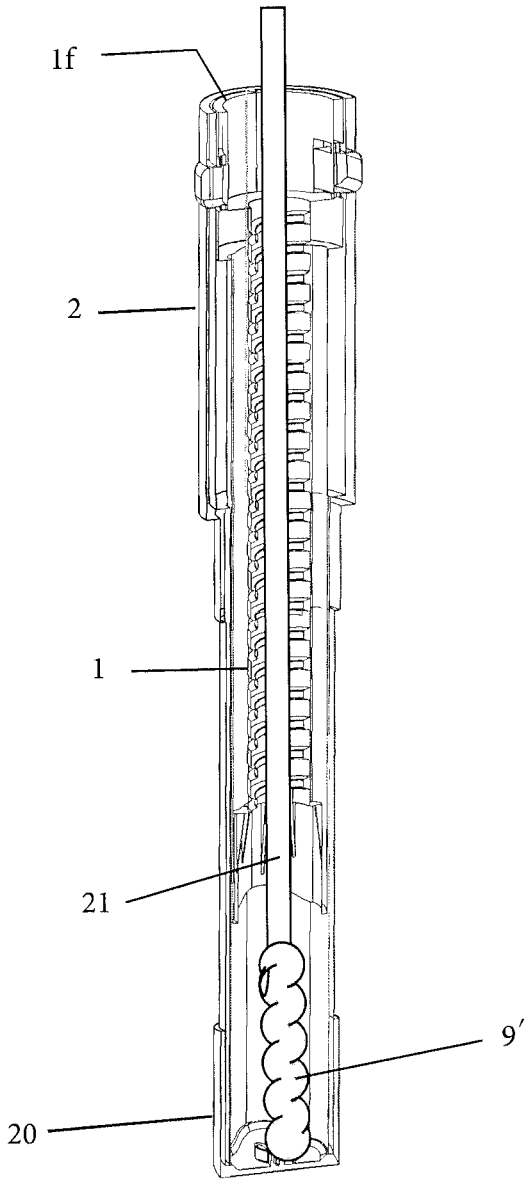
FIG. 24 depicts a refillable dispenser being bottom filled.

A replaceable cartridge subassembly (8) according to the invention may be bottom filled or top filled. Preferably, the cartridge is bottom filled. Referring to FIG. 24, bottom filling should be done with the holder cup (1) in a fully retracted position within the A-shell (2). A molding cap (20) is placed over the distal end (2*g*) of the A-shell (2). Preferably, the molding cap has a complementary shape to the distal end of the A-shell (see FIG. 23). With the cartridge in an inverted position, a product filling nozzle (21) is inserted through the proximal end (1*f*) of the holder cup. Softened product (9') flows into the cartridge. A volume in the cartridge between the molding cap and the cup of the holder cup, is filled with product. Preferably, product filling will continue until some product has reached into the threaded shaft (1*l*) of the holder cup, but such that the threaded spiral (3*l*) of the inner base (3) does not reach into the product. Preferably, at least one thread turn of the threaded shaft is filled with product. More preferably, at least two thread turns of the threaded shaft are filled with product. This will give excellent retention force to the final stick product. Once the filled product has cooled and, the cartridge can be turned right-side-up. The molding cap (20) may be removed from the A-shell or retained for protecting the stick product during distribution. The filled cartridge (8) is ready to be assembled into an inner base (3) and an outer base (4), and closed off with a closure (5). Bottom filling of the cartridge is preferred when the stick product is relatively softer and may benefit from the support provided by the cylindrical wall (2*b*) of the of the A-shell.

Alternatively, a replaceable cartridge (8) according to the invention may be top filled. With the holder cup (1) in a fully elevated position, a previously prepared stick product (9) may be inserted into the holder cup down to the bottom (1*i*) of the holder cup. As the holder cup is retracted into the A-shell (2), the sides of the stick product do not contact the walls of the A-shell. When the holder is fully retracted, a molding cap (20) may be placed over the distal end of the A-shell to protect the stick product during distribution. The filled cartridge (8) is ready to be assembled into an inner base (3) and an outer base (4), and closed off with a closure (5). This top fill method is practical for relatively stiffer stick products (9) that do not require the support of the A-shell (2).

Operation of the Dispenser

To operate the refillable dispenser (10), the closure (5) is removed from the A-shell (2) and outer base (4). If there is a molding cap (20) on the distal end (2*g*) of the A-shell, it is also removed. In the fully retracted configuration of the refillable dispenser, the tabs (1*n*) of the holder cup (1) are sitting in the apertures (2*m*) of the A-shell, however, due to the rounded edges (1*p*) of the tabs, translation between the holder cup and the A-shell is possible. This is because the radius of curvature of the rounded edges is equal to or greater than the thickness of the lower cylindrical wall (2*d*) of the A-shell. Thus, when opposing twisting forces are applied to the A-shell and inner base (or the optional outer base), rotation of the holder cup is prevented by the means provided for that purpose (such as, the oval wall (1*d*) of the lower step (1*c*) of the holder cup (1) striking the longitudinal splines (2*q*) of the A-shell). As a result, the holder cup will be urged upward within the A-shell. When the tabs (1*n*) strike the top of the apertures (2*m*), they will be displaced radially inward, forcing the tabs out of the apertures of the A-shell. With additional twisting between the A-shell and outer base, the holder cup will continue to rise freely within the A-shell until the shoulder (le) of the holder cup strikes the shoulder (2*e*) of the A-shell. At this point, the holder cup is fully extended. When the twisting forces are reversed, the holder cup is retracted until the tabs of the holder cup return to the apertures of the A-shell, at which point, the holder cup is again fully retracted. The closure (5) may be replaced on the A-shell and outer base.

Method of Replacing the Cartridge

When a user wishes to replace a cartridge, the closure (5) is removed from the refillable dispenser (10). Then the outer base (4), if provided, is separated from the inner base (3) by pushing down on the distal end of the A-shell (2) while pulling up on the outer base, to overcome the friction between the outer base and inner base. Next, the cartridge (8) is separated from the inner base by holding the A-shell steady while unscrewing the inner base from the holder cup (1). The inner base, outer base and closure may be used again and again with new cartridges of fresh stick product (9). A new cartridge is assembled to the inner base by holding the A-shell steady while screwing the inner base into the holder cup until the A-shell bottoms out on the closed end (3*f*) of the inner base. The proximal end (4*f*) of the outer base (4) is slipped over the distal end (2*g*) of the A-shell (2), and slid down until the shoulder (4*e*) of the outer base contacts the shoulder (2*e*) of the A-shell. The closure (5) is fitted onto the distal end (2*g*) of the refillable dispenser (10).

What is claimed is:

1. A cartridge subassembly for a stick product comprising:

a holder cup that is formed as a hollow stepped tube, the holder cup comprising:

an upper step;

a lower step that has at least one cutout;

a tab positioned in each of the at least one cutouts and connected to the holder cup by flexible struts that allow the tabs to move radially inward when pressure is applied to the tabs, and return again when pressure is removed;

a distal end that is fashioned as a cup that is able to support one end of a stick product; and a threaded shaft that is formed on an inner surface of the holder cup;

an A-shell that is formed as a hollow stepped tube, the A-shell comprising:

an upper step;

a lower step that has a proximal end and at least one aperture;

wherein:

the holder cup is situated inside the A-shell, and the at least one tab of the holder cup protrudes through the at least one aperture of the A-shell, such that the holder cup and A-shell cannot move relative to each other.

2. A cartridge subassembly for a stick product according to claim 1, in which:

the lower step of the holder cup and the lower step of the A-shell have different cross sectional shapes, such that:

the lower step of the holder cup can fit into the lower step of the A-shell in at least one relative orientation, and cannot fit into the lower step of the A-shell in at least one other relative orientation.

3. A cartridge subassembly for a stick product according to claim 1, in which:

the upper step of the holder cup and the upper step of the A-shell have the same non-circular cross sectional shape.

4. A refillable dispenser for a stick product that comprises:

a cartridge subassembly according to claim 1;

an inner base that comprises:

a cylindrical wall;

a closed end that has an inner surface; and a threaded spiral that rises from the inner surface of the closed end, and that has a distal end;

wherein:

the threaded spiral of the inner base is threaded into the threaded shaft of the cartridge subassembly;

the at least one tab of the holder cup is biased inwardly by the cylindrical wall of the inner base; and the holder cup is prevented from rotating with respect to the A-shell, but it can translate up and down within the A-shell by a relative rotation of the A-shell and the inner base.

5. A refillable dispenser according to claim 4 wherein the cup of the holder cup has a bottom that has an opening for product filling.

6. A refillable dispenser according to claim 5 wherein when the proximal end of the A-shell is bottomed out in the inner base, then the distal end of the threaded spiral is at least one full thread turn below the cup of the holder cup.

7. A refillable dispenser according to claim 6 further comprising:

an outer base that is formed as a hollow stepped tube that is slipped over the A-shell and covers the lower step of the A-shell and the inner base.

8. A refillable dispenser according to claim 7 further comprising:

a plurality of longitudinal grooves located on an outside surface of the cylindrical wall of the inner base;

a plurality of longitudinal projections located on an inner surface of a cylindrical wall of a lower step of the outer base;

wherein the longitudinal projections of the outer base rest in the longitudinal grooves of the inner base.

9. A refillable dispenser according to claim 7 that uses no lubricant.

10. A method of filling a cartridge subassembly comprising the steps of:

providing a cartridge subassembly according to claim 5;

fully retracting the holder cup within the A-shell;

placing a molding cap over a distal end of the A-shell;

inverting the cartridge subassembly;

inserting a product filling nozzle through a proximal end of the holder cup; and filling a volume in the cartridge between the molding cap and the bottom of the cup, with product.

11. A method of filling a cartridge subassembly according to claim 10, further comprising the step of continuing to fill product until at least one thread turn of the threaded shaft is filled with product.

* * * * *